US007954331B2

(12) United States Patent
Ullman

(10) Patent No.: US 7,954,331 B2
(45) Date of Patent: Jun. 7, 2011

(54) THERMALLY-BALANCED SOLID STATE COOLING

(75) Inventor: Alan Z. Ullman, Northridge, CA (US)

(73) Assignee: The Boeing Company, Chicago, IL (US)

( * ) Notice: Subject to any disclaimer, the term of this patent is extended or adjusted under 35 U.S.C. 154(b) by 508 days.

(21) Appl. No.: 12/099,401

(22) Filed: Apr. 8, 2008

(65) Prior Publication Data

US 2009/0249796 A1 Oct. 8, 2009

(51) Int. Cl.
*F25B 21/02* (2006.01)

(52) U.S. Cl. ..... 62/3.2; 62/3.3; 62/3.6

(58) Field of Classification Search ..... 62/3.2, 62/3.3, 3.6, 3.7, 259.2
See application file for complete search history.

(56) References Cited

U.S. PATENT DOCUMENTS 4,065,936 A * 1/1978 Fenton et al. ..... 62/3.3
5,544,487 A * 8/1996 Attey et al. ..... 62/3.7
5,940,784 A * 8/1999 El-Husayni ..... 702/130
6,401,462 B1 * 6/2002 Bielinski ..... 62/3.7
6,705,089 B2 * 3/2004 Chu et al. ..... 62/3.2
7,106,777 B2 9/2006 Delgado, Jr. et al.
2004/0068991 A1 * 4/2004 Banney et al. ..... 62/3.7
2005/0072165 A1 * 4/2005 Bell ..... 62/3.7

OTHER PUBLICATIONS

Website material, entitled "Aircraft Pod Environmental Control System (ECS)," by Fairchild Controls Corporation at http://www.fairchild-controls.com/products/aircraft-pod-environmental-control.php obtained on Dec. 1, 2010; 2 pages.

* cited by examiner

*Primary Examiner* — Melvin Jones
(74) *Attorney, Agent, or Firm* — Hope Baldauff Hartman, LLC

(57) ABSTRACT

Apparatus, systems, and methods provide for the cooling of a system on an aircraft or other platform. According to embodiments described herein, a first coolant is routed through a heat-producing system to absorb heat and maintain the system at a desired temperature. The first coolant is routed through a thermoelectric chiller for cooling before returning to absorb further heat from the system. Thermoelectric cooler modules within the chiller transfer heat from cold plates containing the first coolant to hot plates containing a second coolant. The second coolant absorbs the transferred heat and is routed to a radiator, where the heat is discharged into an ambient air stream. The second coolant is routed back to the hot plates to absorb further heat.

23 Claims, 3 Drawing Sheets

THERMALLY-BALANCED SOLID STATE COOLING

BACKGROUND

Aircraft are utilized for many different purposes, from transporting passengers and cargo to implementing weapons systems. In many of these roles, it is important to provide cooling to one or more payloads or aircraft systems. Certain heat-generating systems are temperature sensitive, requiring that the system be continuously cooled to maintain a desired temperature range. Depending on the desired temperature range, the heat-generating characteristics of the system, and the environmental conditions in and around the aircraft, cooling the system to maintain the desired temperature range can be challenging.

Conventional cooling methods such as refrigeration systems are often large, heavy, and have significant power demands. However, due to space, weight, and power limitations associated with some aircraft, conventional cooling methods are inadequate for aircraft systems requiring substantial and continuous cooling. It is with respect to these considerations and others that the disclosure made herein is presented.

SUMMARY

It should be appreciated that this Summary is provided to introduce a selection of concepts in a simplified form that are further described below in the Detailed Description. This Summary is not intended to be used to limit the scope of the claimed subject matter.

Apparatus, systems, and methods described herein provide for the cooling of an aircraft system. According to one aspect of the disclosure provided herein, a heat exchanger includes a coolant loop that moves a coolant through a heat-producing system to absorb heat from the system and a thermoelectric chiller to extract the heat from the coolant. The heated coolant is routed through a cold plate of the thermoelectric chiller. The heat from the coolant is transferred into the cold plate and the coolant is returned to the coolant loop to absorb additional heat from the system prior to being cycled back through the cold plate. One or more thermoelectric cooler modules remove heat from the cold plate and transfer the heat to a hot plate, maintaining the temperature of the cold plate below that of the heated coolant in order to continuously extract heat from the coolant. The hot plate transfers the heat from the cold plate into another coolant loop.

According to one implementation of the disclosure, the thermoelectric chiller includes multiple cold plates and hot plates in an alternating configuration, with a number of thermoelectric cooler modules mounted in closely-spaced rows and columns between the cold plates and hot plates. The thermoelectric cooler modules are mounted on opposing sides of the cold plates so that heat is efficiently transferred from both sides of the cold plates to the hot plates. The number of columns and rows of thermoelectric cooler modules may be dependent upon the flow direction of the coolants through the cold plates and hot plates.

According to another aspect, a cooling system for removing heat from an aircraft system includes a system coolant loop for providing coolant to the heat-producing system, a thermoelectric chiller for transferring heat from the heated coolant to another coolant loop, and a heat discharge mechanism for extracting and discharging the heat from the thermoelectric chiller. The thermoelectric chiller includes a cold plate, a hot plate, and one or more thermoelectric cooler modules positioned between the cold plate and the hot plate. Heated coolant from the heat-producing system flows through the cold plate, is cooled by the cold plate, and is returned to the system coolant loop. The thermoelectric cooler modules transfer the heat from the cold plate to the hot plate. Low-temperature coolant from another coolant loop flows through the hot plate to absorb the heat provided by the thermoelectric cooler modules. The heat discharge mechanism cools the coolant from the hot plate. According to one implementation, the heat discharge mechanism includes a radiator that transfers heat from the coolant discharged from the hot plate to an ambient air stream.

The features, functions, and advantages that have been discussed can be achieved independently in various embodiments of the present invention or may be combined in yet other embodiments, further details of which can be seen with reference to the following description and drawings.

DETAILED DESCRIPTION

The following detailed description is directed to apparatus, systems, and methods for utilizing a thermoelectric chiller to cool a heat-producing aircraft system. As discussed briefly above, due to the nature of aircraft operations, providing cooling functionality to reduce and maintain the temperature of a payload or system is subject to certain fixed constraints. The specific operational and physical characteristics of the particular platform supporting the system, as well as the power consumption, footprint, and weight characteristics of the cooling system are just a few of the parameters that must be considered and reconciled when choosing or designing a cooling system. For example, utilizing ice to cool a system is not practical in most aircraft scenarios given the weight and rapid consumption associated with ice. Typical refrigeration systems also are weight prohibitive in many aircraft operational scenarios in which substantial continuous cooling is desired. Many conventional refrigeration systems are also sensitive to the vibration environment in an aircraft and require special modifications for aircraft use.

Utilizing the concepts and technologies described herein, water or other coolant may be used to absorb heat from a system, which may then cooled using aircraft electrical power via a thermoelectric chiller as described below. In doing so, continuous cooling of aircraft systems is achieved in a weight-acceptable manner using aircraft power. Throughout this disclosure, embodiments are described with respect to an aircraft system. It should be understood that the concepts presented herein are equally applicable to cool any system, subsystem, and/or payload of any platform, including aircraft, ships, vehicles, or any other platform in which sufficient electrical power is available.

Figure 1:
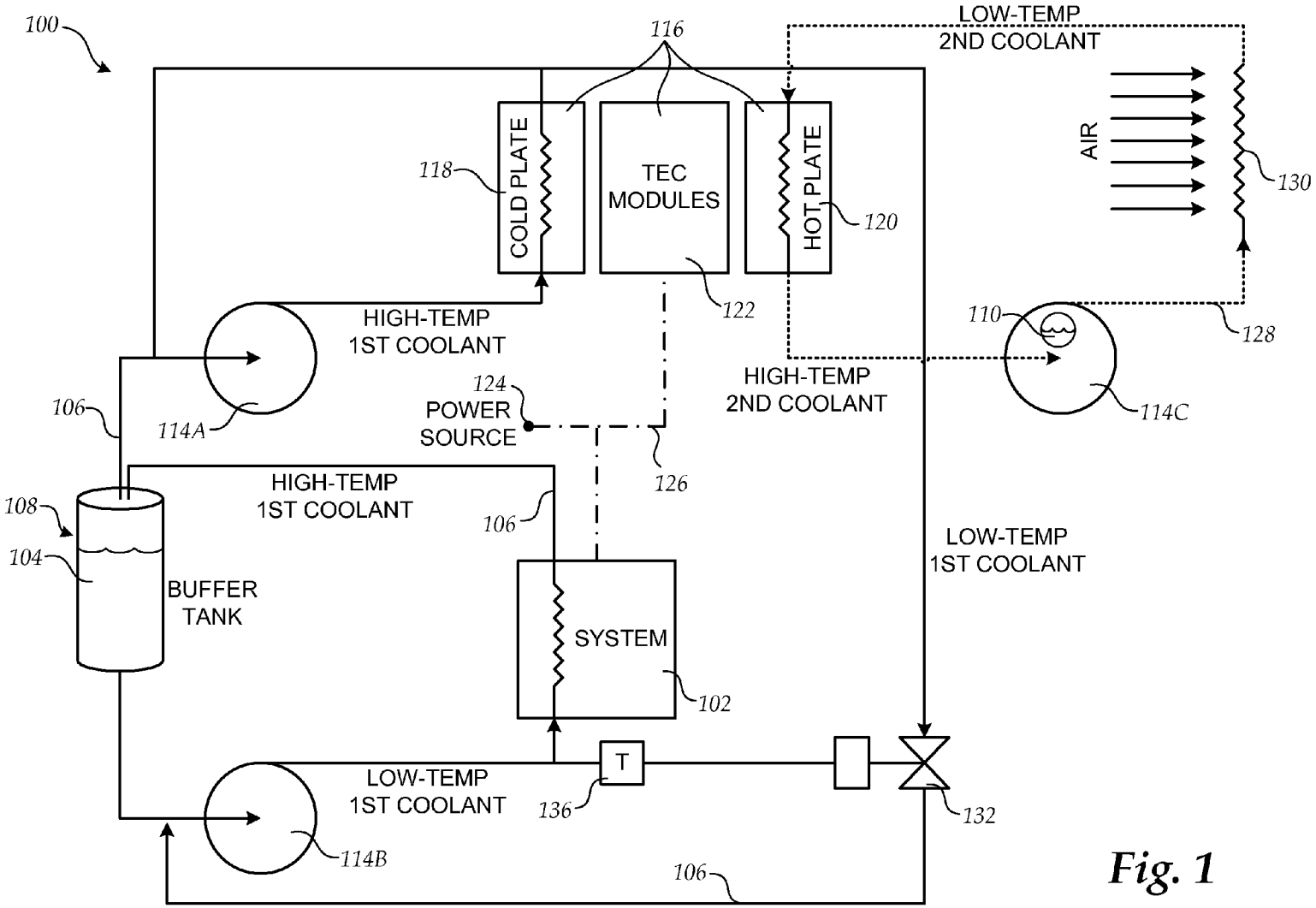
FIG. 1 is a schematic diagram showing a cooling system for cooling a heat-producing system according to various embodiments presented herein.

In the following detailed description, references are made to the accompanying drawings that form a part hereof, and which are shown by way of illustration, specific embodiments, or examples. Referring now to the drawings, in which like numerals represent like elements through the several figures, evaporative cooling of an aircraft system will be described. FIG. 1 shows a schematic diagram of a cooling system 100 according to one embodiment described herein. The cooling system 100 is used to reduce and maintain the temperature of a heat-producing system 102. The cooling system 100 may be referred to herein as a heat exchanger, as it functionally provides for the transfer of heat between the heat-producing system 102, a first coolant 104, a second coolant 110, and air.

It should be understood that the heat-producing system 102 may be any type of payload or aircraft system/subsystem that generates heat. According to one implementation, the heat-producing system 102 is a laser or other directed energy weapon or device. Due to the nature of lasers, substantial cooling is typically required to support sustained operation of the laser. The concepts described herein provide this sustained cooling at a weight that allows the cooling system 100 to be utilized on an aircraft or other platform with strict weight limitations.

For clarity, the functionality of the cooling system 100 will be generally described before describing each element of the cooling system 100 in detail. The cooling system 100 utilizes a first coolant 104 to absorb heat from the heat-producing system 102 in order to maintain the heat-producing system 102 at a desired temperature range. The first coolant 104 is cooled by a thermoelectric chiller 116 before being re-circulated back through the heat-producing system 102 to absorb further heat, which cools the heat-producing system 102. Within the thermoelectric chiller 116, heat is transferred from the first coolant 104 to a second coolant 110. The second coolant 110 is then circulated around a heat discharge loop 128 to a heat discharge mechanism 130, where the heat absorbed by the second coolant 110 in the thermoelectric chiller 116 is discharged prior to recirculation of the second coolant 110 back to the thermoelectric chiller 116 for further heat absorption.

The cooling system 100 includes a system coolant loop 106 for routing the first coolant 104 through the heat-producing system 102 and through the thermoelectric chiller 116. According to one embodiment, the first coolant 104 may be water, which is used as described below to absorb heat from the heat-producing system 102 and subsequently cooled and returned to the system coolant loop 106 to be re-routed to the heat-producing system 102. Due to the relatively high heat capacity of water, water has the ability to absorb a large quantity of heat for a relatively small weight. Although the first coolant 104 may include water according to various implementations, it should be understood that any type of liquid may be used as the first coolant 104 without departing from the scope of this disclosure.

The first coolant 104 may be routed through the heat-producing system 102 in a manner that most efficiently absorbs heat from the heat-producing system 102. For example, a radiator-type configuration may be used to circulate the first coolant 104 through the heat-producing system 102 to absorb heat and effectively cool the heat-producing system 102. After absorbing heat from the heat-producing system 102, the high-temperature first coolant 104 may be routed directly from the heat-producing system 102 to the thermoelectric chiller 116, or be routed to the thermoelectric chiller 116 via a buffer tank 108, which is described in detail below. After leaving the heat-producing system 102, the high-temperature first coolant 104 has been heated to a temperature in which it can no longer efficiently absorb heat from the heat-producing system 102. For this reason, the temperature of the high-temperature first coolant 104 must be reduced using the thermoelectric chiller 116 before the first coolant 104 is re-circulated to the heat-producing system 102 to further aid in maintaining the temperature of the heat-producing system 102 within the desired temperature range.

As stated above, the system coolant loop 106 may include a buffer tank 108. The buffer tank 108 should be of sufficient volume to store the quantity of water or other first coolant 104 used within the system coolant loop 106 and to allow for expansion and contraction of the first coolant 104 within the cooling system 100 that results from temperature changes. The volume of the buffer tank may depend upon the thermal inertia characteristics of the first coolant 104, the temperature differential between the high-temperature first coolant 104 from the heat-producing system 102 and the low-temperature first coolant 104 discharged into the system coolant loop 106 from the thermoelectric chiller 116, as well as the volume of first coolant 104 present in the cooling system 100.

According to the embodiment shown in FIG. 1, the buffer tank 108 is positioned within the system coolant loop 106 so that the first coolant 104 is circulated between the buffer tank 108 and the heat-producing system 102. High-temperature first coolant 104 from the heat-producing system 102 is drawn from the buffer tank 108 and routed to the thermoelectric chiller 116. Low-temperature first coolant 104, which results from the extraction of heat from the high-temperature first coolant 104 within the thermoelectric chiller 116, is then routed back into the system coolant loop 106 and through the heat-producing system 102 to absorb further heat and control the temperature of the heat-producing system 102.

While the buffer tank 108 is shown in FIG. 1 to be positioned within the system coolant loop 106 such that first coolant 104 is circulated between the buffer tank 108 and the heat-producing system 102, it should be understood that the cooling system 100 may be configured such that the buffer tank 108 is positioned anywhere within the system coolant loop 106 such that it allows for the expansion and contraction of the first coolant 104 within the cooling system 100. Additionally, a temperature control 136 may be used to measure the temperature of the heat-producing system 102. The temperature of the heat-producing system 102 is then used to determine the flow rate at which the first coolant 104 should be pumped through the system coolant loop 106 in order to maintain the temperature of the heat-producing system 102 within a desired range.

In order to route the first coolant 104 and a second coolant 110 that will be described below through the various sections and elements of the cooling system 100, one or more pumps 114A-114C are used. It should be appreciated that any number and type of pumps may be used to control the flow of coolant 104 through the cooling system 100, depending on the configuration of the cooling system 100. For example, in the embodiment shown in FIG. 1, the pump 114B circulates the first coolant 104 between the buffer tank 108 and the heat-producing system 102. The pump 114A pumps the first coolant 104 from the buffer tank 108 to the thermoelectric chiller 116.

The pump 114C circulates the second coolant 110 through the heat discharge loop 128, which is described in detail below. It should be appreciated that the pumps 114A and 114B may be positioned at any location to control the flow of the first coolant 104 between the heat-producing system 102, the thermoelectric chiller 116, and the buffer tank 108. Similarly, the pump 114C may be positioned anywhere within the heat discharge loop 128 to control the flow of the second coolant 110 between the thermoelectric chiller 116 and a heat discharge mechanism 130, which will be described in detail below.

As previously discussed, the cooling system 100 absorbs heat from the heat-producing system 102 using the first coolant 104. Once the first coolant 104 is heated, the heat must be dissipated before the first coolant 104 can be re-circulated through the heat-producing system 102 to absorb further heat. Embodiments described herein provide for absorbing heat from the first coolant 104 using the thermoelectric chiller 116. The thermoelectric chiller 116 effectively utilizes electrical power 126 from a power source 124 to transfer heat from the first coolant 104 to the second coolant 110. It should be appreciated that the power source 124 may be an aircraft auxiliary power unit (APU), generator, or any other source of electricity that is capable of supplying the power consumed by the thermoelectric chiller 116, heat-producing system 102, and/or any other aircraft system, subsystem, or payload.

The thermoelectric chiller 116 utilizes a combination of cold plates 118, hot plates 120, and thermoelectric cooler modules 122 to effectively transfer heat between the first coolant 104 and the second coolant 110. The first coolant 104 flows through the cold plates 118, where heat is transferred from the high-temperature first coolant 104 to the lower-temperature cold plates 118. To maintain the cooling capacity of the cold plates 118, heat must be transferred away from the cold plates 118. The thermoelectric cooler modules 122 provide this function by pumping the heat from the cold plates 118 to the hot plates 120. A thermoelectric cooler module 122 is a solid-state heat pump that transfers heat from a cold side to a hot side of the thermoelectric cooler module 122.

If the cold side of the thermoelectric cooler module 122 abuts a surface of a thermally conductive object and the hot side of the thermoelectric cooler module 122 abuts a surface of another thermally conductive object, then the thermoelectric cooler module 122 may effectively transfer heat from the surface of one object to the surface of the other object. The thermoelectric cooler modules 122 utilize electrical power 126 to transfer heat between the hot side and the cold side of the thermoelectric cooler modules 122. In doing so, thermoelectric cooler modules 122 may not be as efficient as typical refrigeration systems. However, properly configured within the thermoelectric chiller 116 and cooling system 100 according to the disclosure provided herein, the thermoelectric cooler modules 122 effectively cool the first coolant 104 within the weight and space limitations of an aircraft or other mobile platform utilizing the abundant electrical power provided by the aircraft or other mobile platform.

The ratio of the amount of cooling produced by the thermoelectric cooler modules 122 to the electrical power 126 consumed is called the coefficient of performance (COP). The COP depends on the temperature difference across, and the current supplied to, the thermoelectric cooler modules 122. Heat from the thermoelectric cooler modules 122 may be deposited to the hot plates 120 in an amount equal to the cooling load from the cold plates 118 plus the amount of electrical power supplied to the thermoelectric cooler modules 122. In situations in which the cooling load is approximately equivalent to the amount of electrical power supplied to the thermoelectric cooler modules 122, then the COP is approximately "1" and the heat deposited to the hot plates 120 would be approximately double the amount of heat absorbed from the cold plates 118. An embodiment of the disclosure provided herein in which the thermoelectric cooler modules 122 operate at a COP of "1" and reject approximately twice as much heat to the hot plates 120 as they absorb from the cold plates 118 is shown in FIG. 2.

Figure 2:
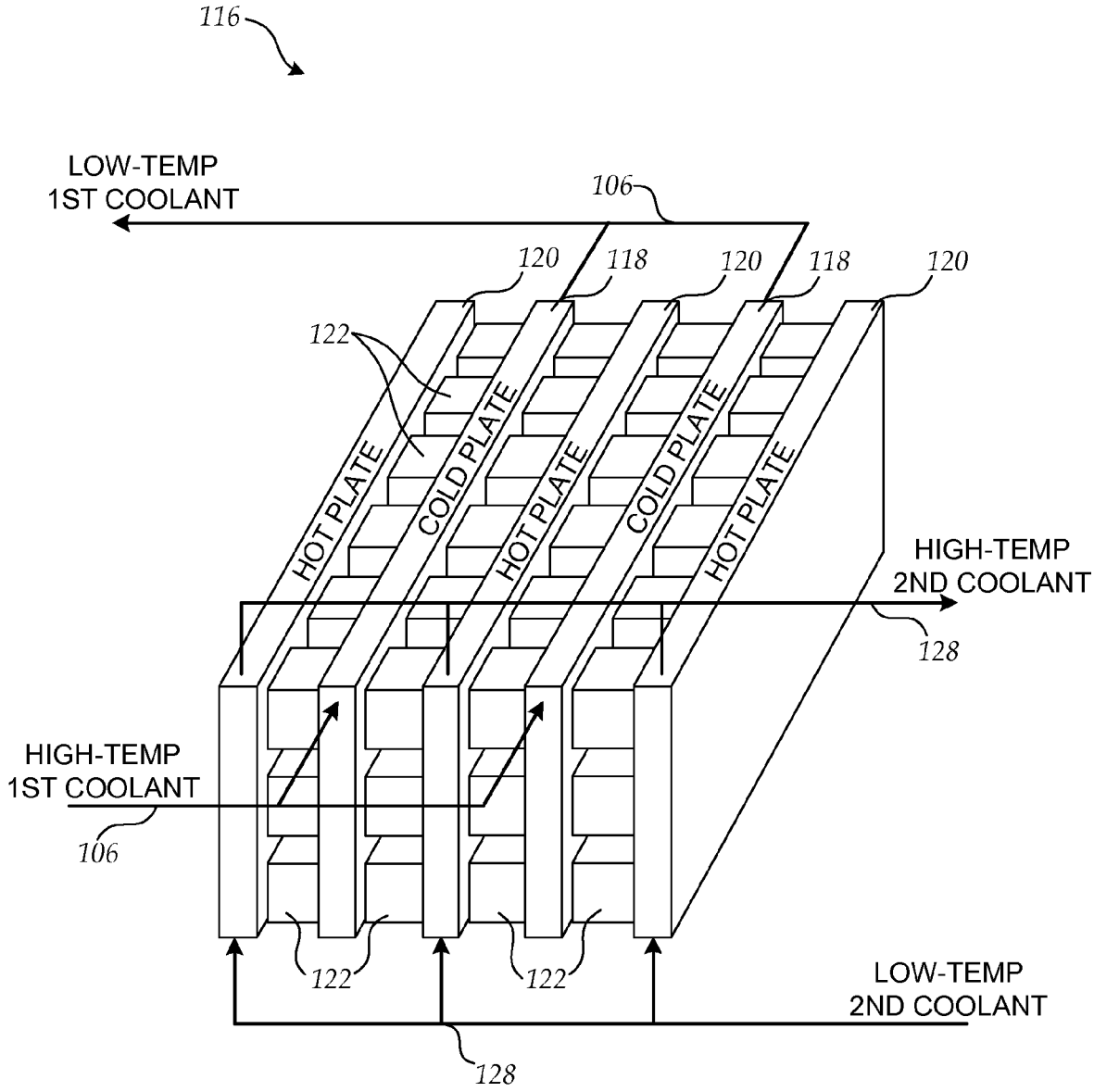
FIG. 2 is a perspective view of a thermoelectric chiller of a cooling system according to various embodiments presented herein.

As seen in FIG. 2, the thermoelectric chiller 116 may include multiple cold plates 118 and hot plates 120, as well as any number of thermoelectric cooler modules 122. The cold plates 118 and the hot plates 120 may be arranged so that they are parallel to one another, in an alternating arrangement. For example, in the example shown in FIG. 2, the thermoelectric chiller 116 includes, from left to right, a hot plate 120 on one end, followed by a cold plate 118, another hot plate 120, another cold plate 118, and a hot plate 120 on the opposite end. Thermoelectric cooler modules 122 are then mounted to the surfaces of the hot plates 120 and cold plates 118 such that the cold sides of the thermoelectric cooler modules 122 abut a surface of a cold plate 118 and the hot sides of the thermoelectric cooler modules 122 abut a surface of an adjacent hot plate 120. It should be understood that the thermoelectric cooler modules 122 may be permanently mounted to the surfaces of the cold plates 118 and hot plates 120 through known techniques such as brazing or welding, or may be impermanently mounted using know techniques such as potting.

A number of thermoelectric cooler modules 122 may be mounted in rows and columns between the various cold plates 118 and hot plates 120. Each cold plate 118 has thermoelectric cooler modules 122 mounted on opposing sides to optimize the amount of heat transferred from the cold plate 118. Likewise, each hot plate 120, with the exception of the hot plates 120 on opposing ends of the thermoelectric chiller 116, has thermoelectric cooler modules 122 mounted on opposing sides to optimize the amount of heat transferred to the hot plate 120. The first coolant 104 and the second coolant 110 flow through the cold plates 118 and hot plates 120, respectively, between thermoelectric cooler modules 122 on opposing surfaces of the cold plates 118 and hot plates 120.

According to the embodiment shown in FIG. 2 in which the thermoelectric cooler modules 122 operate at a COP of approximately unity and reject approximately twice as much heat to the hot plates 120 as they absorb from the cold plates 118, twice the number of thermoelectric cooler modules 122 are mounted in the flow direction of the first coolant 104 within the cold plates 118 than in the flow direction of the second coolant 110 within the hot plates 120. By configuring the thermoelectric chiller 116 in this manner, then if equal quantities of the first coolant 104 and the second coolant 110 are routed through the cold plates 118 and hot plates 120, respectively, at equivalent rates, then the temperature changes of these coolants and corresponding plates are approximately equal. Under these conditions, while each thermoelectric cooler module 122 operates at a slightly different low and high temperature range, this arrangement produces a relatively high average COP.

For example, if one unit of heat is absorbed by a single thermoelectric cooler module 122 from a cold plate 118, then approximately two units of heat are deposited to the adjacent hot plate 120 due to the addition of one unit of heat from the consumed electrical power. In order to balance the temperature changes in the cold plates 118, hot plates 120, and corresponding coolants, if the first coolant 104 flows past three thermoelectric cooler modules 122 on one surface of a cold plate 118, then the second coolant 110 should flow past six thermoelectric cooler modules 122 on a corresponding surface of a hot plate 120.

Balancing the temperature changes amongst the cold plates 118 and hot plates 120, and amongst the corresponding first coolant 104 and second coolant 110, maintains the thermoelectric cooler modules 122 in a narrow temperature range and optimizes the COP of the thermoelectric cooler modules 122. This ensures that the thermoelectric chiller 116 operates as efficiently as possible. It should be clear that the disclosure provided herein is not limited to the configuration shown in FIG. 2. The type and number of thermoelectric cooler modules 122, the materials for manufacturing the cold plates 118 and hot plates 120, the type of first coolant 104 and second coolant 110, the quantity and flow rate of each coolant through the respective cold plates 118 and hot plates 120, and the cooling capability of the heat discharge mechanism 130 described below, are all factors in selecting the most efficient configuration of the thermoelectric chiller 116.

Returning to FIG. 1, after removing heat from the cold plates 118 to the hot plates 120, the heat must be effectively extracted from the hot plates 120 in order to provide for continuous cooling of the cold plates 118. To cool the hot plates 120, the second coolant 110, being of lower temperature than the hot plates 120, is pumped from the heat discharge loop 128 through the hot plates 120. The heat from the hot plates 120 is then absorbed by the low-temperature second coolant 110. According to one embodiment, the second coolant 110 includes water and/or glycol. However, as stated above, it should be understood that the second coolant 110 may be selected according to the specific application.

The heat absorbed by the low-temperature second coolant 110 is discharged from the cooling system 100 using a heat discharge mechanism 130. According to one embodiment, the heat discharge mechanism 130 is a radiator exposed to an ambient airflow. The resulting low-temperature second coolant 110 is then re-circulated back through the hot plates 120 of the thermoelectric chiller 116 to absorb further heat. It should be appreciated that the heat discharge mechanism 130 may be any other type of heat exchanger suitable for reducing the temperature of the second coolant 110 after absorbing heat from the hot plates 120, including the use of the concepts and technologies presented herein. It should also be appreciated that the heat discharge loop 128 may include a buffer tank similar to the buffer tank 108 described above with respect to the system coolant loop 106 to provide for coolant expansion and contraction according to the thermal inertia of the second coolant 110.

It should be understood that the elements of the cooling system 100 may be controlled with a computing device having a processor operative to execute computer-readable instructions stored on a computer storage medium. Using the computer-readable instructions, the processor would monitor the temperature of the heat-producing system 102, control the flow of the first coolant 104 through the system coolant loop 106 and through the thermoelectric chiller 116, control the electrical power 126 supplied to the thermoelectric cooler modules 122, and control the flow of the second coolant 110 through the heat discharge loop 128 and through the thermoelectric chiller 116.

Figure 3:
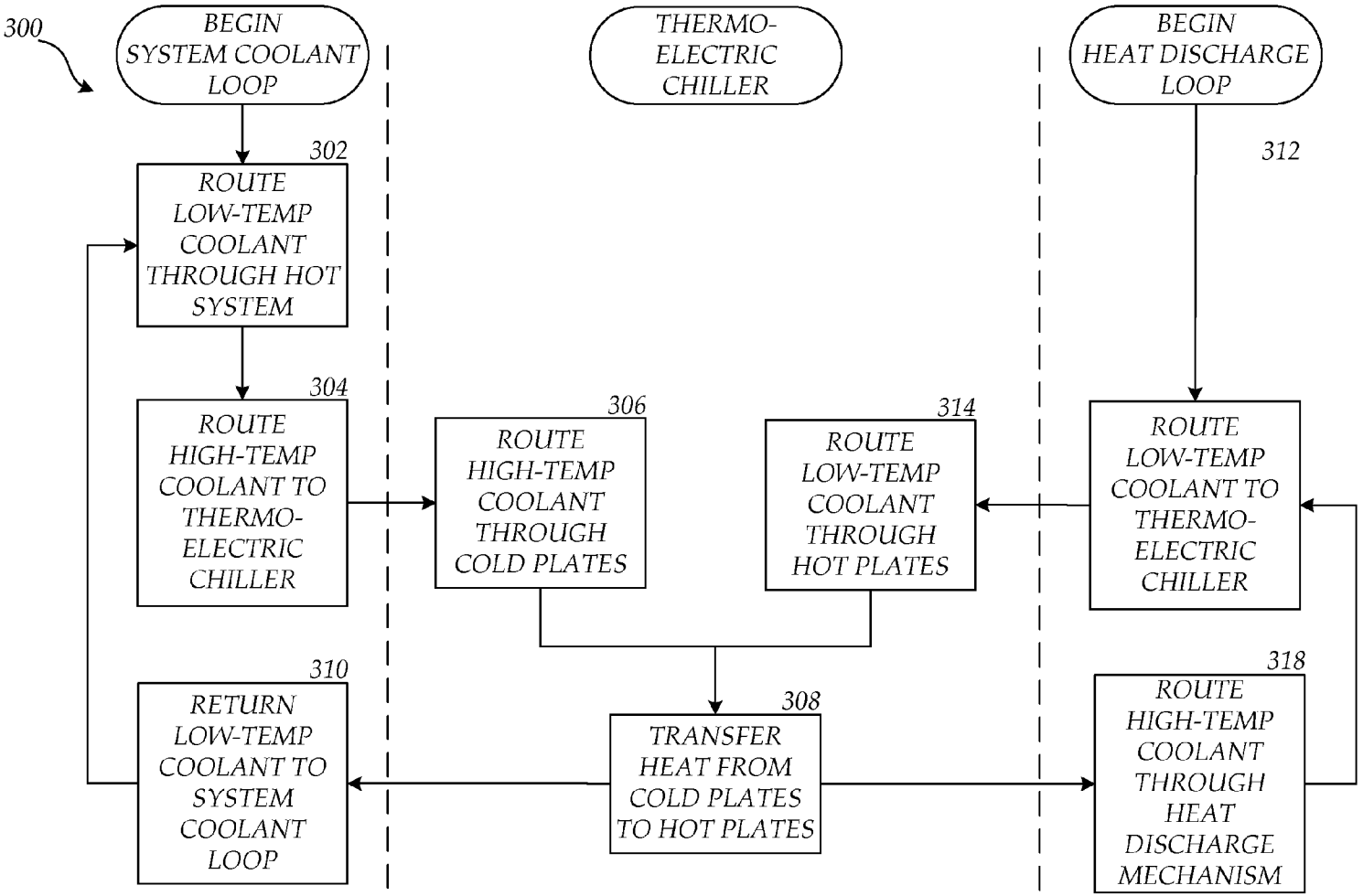
FIG. 3 is a flow diagram illustrating a method for cooling a heat-producing system according to various embodiments presented herein.

Turning now to FIG. 3, an illustrative routine 300 for reducing the temperature of a heat-producing system 102 will now be described in detail. It should be appreciated that more or fewer operations may be performed than shown in the FIG. 3 and described herein. Moreover, these operations may also be performed in a different order than those described herein. FIG. 3 shows the routine 300 separated into three sections to illustrate the various operations as performed within the system coolant loop 106, the thermoelectric chiller 116, and the heat discharge loop 128. The routine 300 begins at operation 302, where the first coolant 104 is routed through the heat-producing system 102. Heat from the system is absorbed by the lower temperature first coolant 104. From operation 302, the routine 300 continues to operation 304, where the high-temperature first coolant 104 is routed to the thermoelectric chiller 116.

From operation 304, the routine 300 continues to operation 306, where the high-temperature first coolant 104 is routed through the cold plates 118 of the thermoelectric chiller 116. As described above, heat from the high-temperature first coolant 104 is transferred from the coolant to the cold plates 118. The routine 300 continues to operation 308, where the thermoelectric cooler modules 122 transfer heat from the cold plates 118 to the hot plates 120. From operation 308, the routine 300 continues to operation 310, where the resulting low-temperature first coolant 104 is returned to the system coolant loop 106. The routine 300 returns to operation 302 from operation 310, where the first coolant 104 is again routed through the heat-producing system 102, which starts the system coolant loop 106 cycle again.

Looking now at the routine 300 beginning with the heat discharge loop 128 at operation 312, low-temperature second coolant 110 is routed to the thermoelectric chiller 116. The routine 300 continues to operation 314, where the low-temperature second coolant 110 is routed through the hot plates 120 of the thermoelectric chiller 116. As described above, heat from the hot plates 120 is transferred to the low-temperature second coolant 110, cooling the hot plates 120. From operation 314, the routine 300 continues to operation 308, where the hot plates 120 continue to absorb heat from the transfer of heat by the thermoelectric cooler modules 122. At operation 318, the resulting high-temperature second coolant 110 is routed through the external radiator or other heat discharge mechanism. The routine 300 returns to operation 312 from operation 318, where the second coolant 110 is again routed to the thermoelectric chiller 116, which starts the heat discharge loop cycle again.

The subject matter described above is provided by way of illustration only and should not be construed as limiting. Various modifications and changes may be made to the subject matter described herein without following the example embodiments and applications illustrated and described, and without departing from the true spirit and scope of the present invention, which is set forth in the following claims.

What is claimed is:

1. A heat exchanger for cooling an aircraft subsystem, comprising:

a system coolant loop configured to move a first low-temperature coolant through a heat-producing system to create a first high-temperature coolant;

a thermoelectric chiller comprising at least one cold plate configured to receive a portion of the first high-temperature coolant, remove heat from the portion of the first high-temperature coolant to produce the first low-temperature coolant, and to discharge the first low-temperature coolant back into the system coolant loop, at least one hot plate configured to receive a second low-temperature coolant, add heat to the second low-temperature coolant to produce a second high-temperature coolant, and to discharge the second high-temperature coolant to a heat discharge loop, and at least one thermoelectric cooler module positioned between the at least one cold plate and the at least one hot plate and operative to transfer heat from the at least one cold plate to the at least one hot plate to maintain the at least one cold plate at a temperature below that of the first high-temperature coolant; and the heat discharge loop configured to move the second low-temperature coolant through the at least one hot plate mechanism and to move the second high-temperature coolant through a heat discharge mechanism configured to extract heat from the second high-temperature coolant to produce the second low-temperature coolant.

2. The heat exchanger of claim 1, wherein the first low-temperature coolant and the first high-temperature coolant comprises water.

3. The heat exchanger of claim 2, wherein the second low-temperature coolant and the second high-temperature coolant comprises glycol.

4. The heat exchanger of claim 1, wherein the heat discharge mechanism comprises a radiator configured to transfer heat from the second high-temperature coolant to an ambient air stream.

5. The heat exchanger of claim 1, wherein the thermoelectric chiller comprises a plurality of cold plates, a plurality of hot plates, and a plurality of thermoelectric cooler modules, and wherein the thermoelectric chiller is configured such that the plurality of cold plates and the plurality of hot plates are positioned parallel to one another in an alternating cold plate and hot plate arrangement with the plurality of thermoelectric cooler modules mounted to the plurality of cold plates and to the plurality of hot plates such that when consuming power, the thermoelectric cooler modules are operative to transfer heat from opposing surfaces of each of the plurality of cold plates to a surface of a hot plate.

6. The heat exchanger of claim 1, further comprising a buffer tank within the coolant loop, wherein the buffer tank is operative to supply coolant to the coolant loop and comprises a sufficient volume to accommodate coolant volume changes corresponding to coolant temperature changes.

7. The heat exchanger of claim 1, wherein the heat-producing system comprises a laser.

8. A method for cooling an aircraft system, comprising:

routing a first low-temperature coolant in a system coolant loop through a heat-producing system to create a first high-temperature coolant in the system coolant loop;

routing the first low-temperature coolant through a cold plate of a thermoelectric chiller;

transferring heat from the first high-temperature coolant to the cold plate of the thermoelectric chiller to transform the first high-temperature coolant to the first low-temperature coolant;

returning the first low-temperature coolant from the cold plate to the system coolant loop for re-routing through the heat-producing system;

transferring heat from the cold plate to a hot plate of the thermoelectric chiller;

routing a second low-temperature coolant through the hot plate;

transferring heat from the hot plate to the second low-temperature coolant to transform the second low-temperature coolant to a second high-temperature coolant; and routing the second high-temperature coolant to a heat discharge mechanism;

transforming the second high-temperature coolant to the second low-temperature coolant in the heat discharge mechanism; and returning the second low-temperature coolant to the hot plate of the thermoelectric chiller.

9. The method of claim 8, wherein the heat discharge mechanism comprises a radiator configured to transfer heat from the second high-temperature coolant to an ambient air stream.

10. The method of claim 8, wherein the thermoelectric chiller comprises a plurality of cold plates, a plurality of hot plates, and a plurality of thermoelectric cooler modules, and wherein the thermoelectric chiller is configured such that the plurality of cold plates and the plurality of hot plates are positioned parallel to one another in an alternating cold plate and hot plate arrangement with the plurality of thermoelectric cooler modules mounted to the plurality of cold plates and to the plurality of hot plates such that when consuming power, the plurality of thermoelectric cooler modules are operative to transfer heat from opposing surfaces of each of the plurality of cold plates to a surface of a hot plate.

11. The method of claim 8, wherein the aircraft heat-producing system comprises a laser.

12. A cooling system for removing heat from a heat-producing system of an aircraft, the cooling system comprising:

a system coolant loop configured to move a first low-temperature coolant through the aircraft system to absorb heat from the aircraft system to create a first high-temperature coolant;

a thermoelectric chiller positioned within the system coolant loop, comprising a cold plate configured to receive the first high-temperature coolant from the system coolant loop and to discharge the first low-temperature coolant into the system coolant loop, a hot plate configured to receive a second low-temperature coolant from a heat discharge loop and to discharge a second high-temperature coolant into the heat discharge loop, and a thermoelectric cooler module positioned between the cold plate and the hot plate such that a cold side of the thermoelectric cooler module abuts a surface of the cold plate and a hot side of the thermoelectric cooler module abuts a surface of the hot plate, wherein the thermoelectric cooler module is operative to transfer heat from the surface of the cold plate to the surface of the hot plate to transform the first high-temperature coolant to the first low-temperature coolant and the second low-temperature coolant to the second high-temperature coolant; and a heat discharge mechanism positioned within the heat discharge loop and configured to extract and discharge heat from the second high-temperature coolant to produce the second low-temperature coolant for routing to the hot plate.

13. The cooling system of claim 12, wherein the heat discharge mechanism comprises a radiator configured to transfer heat from the second high-temperature coolant to an ambient air stream.

14. The cooling system of claim 12, wherein the thermoelectric chiller further comprises a plurality of thermoelectric cooler modules arranged in a plurality of rows and a plurality of columns, wherein a number of columns comprises approximately twice a number of rows, wherein the first high-temperature coolant flows through the cold plate in a direction parallel with the plurality of rows, and wherein the second low-temperature coolant flows through the hot plate in a direction parallel with the plurality of columns.

15. A heat exchanger for cooling an aircraft subsystem, comprising:

a system coolant loop configured to move a first low-temperature coolant through a heat-producing system to create a first high-temperature coolant; and a thermoelectric chiller comprising a plurality of cold plates configured to receive a portion of the first high-temperature coolant, remove heat from the portion of the first high-temperature coolant to produce the first low-temperature coolant, and to discharge the first low-temperature coolant back into the system coolant loop, a plurality of hot plates configured to receive a second low-temperature coolant, add heat to the second low-temperature coolant to produce a second high-temperature coolant, and to discharge the second high-temperature coolant to a heat discharge loop, and a plurality of thermoelectric cooler modules positioned between the plurality of cold plates and the plurality of hot plates and operative to transfer heat from the plurality of cold plates to the plurality of hot plates to maintain the plurality of cold plates at a temperature below that of the first high-temperature coolant, wherein the thermoelectric chiller is configured such that the plurality of cold plates and the plurality of hot plates are positioned parallel to one another in an alternating cold plate and hot plate arrangement with the plurality of thermoelectric cooler modules mounted to the plurality of cold plates and to the plurality of hot plates such that when consuming power, the thermoelectric cooler modules are operative to transfer heat from opposing surfaces of each of the plurality of cold plates to a surface of a hot plate.

16. The heat exchanger of claim 15, wherein the thermoelectric chiller is further configured such that a thermoelectric cooler module discharges approximately twice as much heat to the surface of the hot plate as the thermoelectric cooler module absorbs from a surface of a cold plate.

17. The heat exchanger of claim 15, wherein a surface of a cold plate abuts a cold side of a plurality of thermoelectric cooler modules arranged in a plurality of rows and a plurality of columns, wherein a number of columns comprises approximately twice a number of rows, wherein a surface of a hot plate abuts a hot side of the plurality of thermoelectric cooler modules arranged in the plurality of rows and the plurality of columns, wherein the first high-temperature coolant flows through the cold plate in a direction parallel with the plurality of rows, and wherein the second low-temperature coolant flows through the hot plate in a direction parallel with the plurality of columns.

18. A heat exchanger for cooling an aircraft subsystem, comprising:

a system coolant loop configured to move a first low-temperature coolant through a heat-producing system to create a first high-temperature coolant, wherein the system coolant loop comprises a buffer tank operative to supply coolant to the coolant loop and comprises a sufficient volume to accommodate coolant volume changes corresponding to coolant temperature changes; and a thermoelectric chiller comprising at least one cold plate configured to receive a portion of the first high-temperature coolant, remove heat from the portion of the first high-temperature coolant to produce the first low-temperature coolant, and to discharge the first low-temperature coolant back into the system coolant loop, at least one hot plate configured to receive a second low-temperature coolant, add heat to the second low-temperature coolant to produce a second high-temperature coolant, and to discharge the second high-temperature coolant to a heat discharge loop, and at least one thermoelectric cooler module positioned between the at least one cold plate and the at least one hot plate and operative to transfer heat from the at least one cold plate to the at least one hot plate to maintain the at least one cold plate at a temperature below that of the first high-temperature coolant.

19. A heat exchanger for cooling an aircraft subsystem, comprising:

a system coolant loop configured to move a first low-temperature coolant through a heat-producing system to create a first high-temperature coolant, wherein the heat-producing system comprises a laser; and a thermoelectric chiller comprising at least one cold plate configured to receive a portion of the first high-temperature coolant, remove heat from the portion of the first high-temperature coolant to produce the first low-temperature coolant, and to discharge the first low-temperature coolant back into the system coolant loop, at least one hot plate configured to receive a second low-temperature coolant, add heat to the second low-temperature coolant to produce a second high-temperature coolant, and to discharge the second high-temperature coolant to a heat discharge loop, and at least one thermoelectric cooler module positioned between the at least one cold plate and the at least one hot plate and operative to transfer heat from the at least one cold plate to the at least one hot plate to maintain the at least one cold plate at a temperature below that of the first high-temperature coolant.

20. A method for cooling an aircraft system, comprising:

routing a first low-temperature coolant in a system coolant loop through a heat-producing system to create a first high-temperature coolant in the system coolant loop;

routing the first low-temperature coolant through a cold plate of a thermoelectric chiller;

transferring heat from the first high-temperature coolant to the cold plate of the thermoelectric chiller to transform the first high-temperature coolant to the first low-temperature coolant;

returning the first low-temperature coolant from the cold plate to the system coolant loop for re-routing through the heat-producing system;

transferring heat from the cold plate to a hot plate of the thermoelectric chiller via at least one thermoelectric cooler module positioned within the thermoelectric chiller such that a cold side of the at least one thermoelectric cooler module abuts a surface of the cold plate and a hot side of the at least one thermoelectric cooler module abuts a surface of the hot plate;

routing a second low-temperature coolant through the hot plate;

transferring heat from the hot plate to the second low-temperature coolant to transform the second low-temperature coolant to a second high-temperature coolant; and discharging the second high-temperature coolant from the thermoelectric chiller.

21. A method for cooling an aircraft system, comprising:

routing a first low-temperature coolant in a system coolant loop through a heat-producing system to create a first high-temperature coolant in the system coolant loop;

routing the first low-temperature coolant through a cold plate of a thermoelectric chiller, wherein the thermoelectric chiller comprises a plurality of cold plates, a plurality of hot plates, and a plurality of thermoelectric cooler modules, and wherein the thermoelectric chiller is configured such that the plurality of cold plates and the plurality of hot plates are positioned parallel to one another in an alternating cold plate and hot plate arrangement with the plurality of thermoelectric cooler modules mounted to the plurality of cold plates and to the plurality of hot plates such that when consuming power, the plurality of thermoelectric cooler modules are operative to transfer heat from opposing surfaces of each of the plurality of cold plates to a surface of a hot plate;

transferring heat from the first high-temperature coolant to the cold plate of the thermoelectric chiller to transform the first high-temperature coolant to the first low-temperature coolant;

returning the first low-temperature coolant from the cold plate to the system coolant loop for re-routing through the heat-producing system;

transferring heat from the cold plate to a hot plate of the thermoelectric chiller;

routing a second low-temperature coolant through the hot plate;

transferring heat from the hot plate to the second low-temperature coolant to transform the second low-temperature coolant to a second high-temperature coolant; and discharging the second high-temperature coolant from the thermoelectric chiller.

22. The method of claim 21, wherein a surface of a cold plate abuts a cold side of a plurality of thermoelectric cooler modules arranged in a plurality of rows and a plurality of columns, wherein a number of columns comprises approximately twice a number of rows, wherein a surface of a hot plate abuts a hot side of the plurality of thermoelectric cooler modules arranged in the plurality of rows and the plurality of columns, wherein the first high-temperature coolant flows through the cold plate in a direction parallel with the plurality of rows, and wherein the second low-temperature coolant flows through the hot plate in a direction parallel with the plurality of columns.

23. A method for cooling an aircraft system, comprising:

routing a first low-temperature coolant in a system coolant loop through a heat-producing system to create a first high-temperature coolant in the system coolant loop, wherein the heat-producing system comprises a laser;

routing the first low-temperature coolant through a cold plate of a thermoelectric chiller;

transferring heat from the first high-temperature coolant to the cold plate of the thermoelectric chiller to transform the first high-temperature coolant to the first low-temperature coolant;

returning the first low-temperature coolant from the cold plate to the system coolant loop for re-routing through the heat-producing system;

transferring heat from the cold plate to a hot plate of the thermoelectric chiller;

routing a second low-temperature coolant through the hot plate;

transferring heat from the hot plate to the second low-temperature coolant to transform the second low-temperature coolant to a second high-temperature coolant; and discharging the second high-temperature coolant from the thermoelectric chiller.

* * * * *